US010690043B2

(12) United States Patent
Boyesen

(10) Patent No.: US 10,690,043 B2
(45) Date of Patent: Jun. 23, 2020

(54) TWO-STROKE ENGINE AND COMPONENTS THEREOF

(71) Applicant: Boyesen, Inc., Lenhartsville, PA (US)

(72) Inventor: Glen Boyesen, Kutztown, PA (US)

(73) Assignee: Boyesen, Inc., Lenhartsville, PA (US)

( * ) Notice: Subject to any disclaimer, the term of this patent is extended or adjusted under 35 U.S.C. 154(b) by 0 days.

(21) Appl. No.: 16/387,624

(22) Filed: Apr. 18, 2019

(65) Prior Publication Data

US 2019/0323421 A1 Oct. 24, 2019

Related U.S. Application Data

(60) Provisional application No. 62/659,533, filed on Apr. 18, 2018.

(51) Int. Cl.
*F02B 33/06* (2006.01)

(52) U.S. Cl.
CPC ..... *F02B 33/06* (2013.01); *F02B 2720/231* (2013.01)

(58) Field of Classification Search
CPC ..... F02B 2720/231; F02B 33/06
See application file for complete search history.

(56) References Cited

U.S. PATENT DOCUMENTS 1,793,975 A * 2/1931 St Clair ..... F02B 25/00 123/70 R
2,000,267 A * 5/1935 White ..... F02B 3/00 123/71 R
2,167,402 A * 7/1939 Giró ..... F02B 25/00 123/59.7
2,206,272 A * 7/1940 Toth ..... F02B 25/00 60/620
4,185,597 A * 1/1980 Cinquegrani ..... F02B 33/10 123/559.1
4,841,921 A 6/1989 Yang
5,509,382 A 4/1996 Noland
5,694,891 A 12/1997 Liebich
5,791,303 A 8/1998 Skripov
5,884,590 A 3/1999 Minculescu
6,145,488 A 11/2000 Plechner
6,612,273 B1 9/2003 Schumacher
6,874,454 B2 4/2005 Paut
(Continued)

FOREIGN PATENT DOCUMENTS

EP 3128149 A1 2/2017

*Primary Examiner* — Kevin A Lathers
(74) *Attorney, Agent, or Firm* — Howson & Howson LLP

(57) ABSTRACT

A piston arrangement for an engine is provided and includes a crankshaft located within a crank case and a primary piston located within a first cylinder and interconnected to the crankshaft by a first drive rod for converting reciprocating motion of the primary piston within the first cylinder driven by combustion occurring within the first cylinder into rotational motion of the crankshaft. The arrangement also includes a pumping piston located within a second cylinder and interconnected to the crankshaft by a second drive rod for converting the rotational motion of the crankshaft into reciprocating motion of the pumping piston within the second cylinder. The pumping piston is located between the primary piston and the crank case and seals the first and second cylinders from the crankcase. A stepped-piston and a two-stroke engine are also disclosed.

15 Claims, 12 Drawing Sheets

(56) References Cited

U.S. PATENT DOCUMENTS

| | | | | |
|---|---|---|---|---|
| 7,389,755 | B2 * | 6/2008 | Noland | F02B 41/00 123/68 |
| 7,428,886 | B1 | 9/2008 | Minculescu | |
| 7,503,290 | B2 | 3/2009 | Skulic | |
| 7,942,116 | B2 | 5/2011 | Major | |
| 8,347,833 | B2 | 1/2013 | Hu | |
| 9,133,763 | B2 * | 9/2015 | Yan | F02B 75/044 |
| 2005/0268609 | A1 * | 12/2005 | Branyon | F02B 41/06 60/597 |

* cited by examiner

TWO-STROKE ENGINE AND COMPONENTS THEREOF

CROSS REFERENCE TO RELATED APPLICATIONS

This application claims the benefit under 35 USC § 119(e) of U.S. Provisional Patent Application No. 62/659,533, filed Apr. 18, 2018.

BACKGROUND

The present invention relates in general to two-stroke combustion engines and components thereof.

SUMMARY

A piston arrangement for an engine is provided and includes a crankshaft located within a crank case and a primary piston located within a first cylinder and interconnected to the crankshaft by a first drive rod for converting reciprocating motion of the primary piston within the first cylinder driven by combustion occurring within the first cylinder into rotational motion of the crankshaft. The arrangement also includes a pumping piston located within a second cylinder and interconnected to the crankshaft by a second drive rod for converting the rotational motion of the crankshaft into reciprocating motion of the pumping piston within the second cylinder. The pumping piston is located between the primary piston and the crank case and seals the first and second cylinders from the crankcase. The reciprocating motion of the pumping piston within the second cylinder aids in drawing fresh air or air-fuel mixture into the first and second cylinders for a new cycle and aids in pushing exhausted gas-charge of a previous cycle out through an exhaust port.

According to another aspect, an engine or two-stroke engine is provided.

According to a further aspect, a stepped piston arrangement is provided.

BRIEF DESCRIPTION OF THE DRAWINGS

The foregoing and other objects, features and advantages of the embodiments disclosed herein should become apparent from the following description when taken in conjunction with the accompanying drawings.

DETAILED DESCRIPTION

Figure 1:
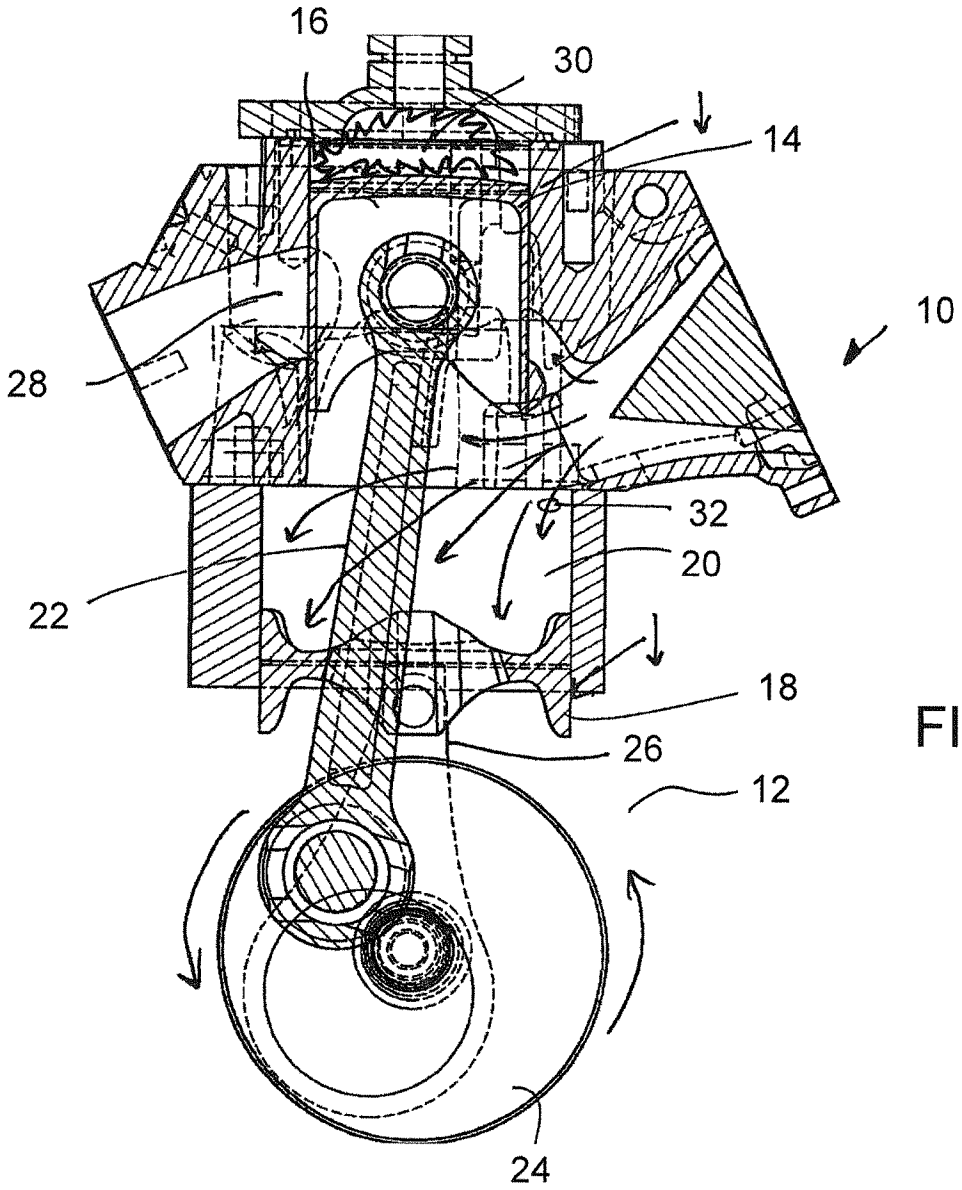
FIG. 1 is a cross-section through a cylinder of a two-stroke engine with the primary piston at 45° after top dead center (ATDC) position according to an embodiment.

For simplicity and illustrative purposes, the principles of the embodiments are described by referring mainly to examples thereof. In the following description, numerous specific details are set forth in order to provide a thorough understanding of the embodiments. It will be apparent however, to one of ordinary skill in the art, that the embodiments may be practiced without limitation to these specific details. In some instances, well known methods and structures have not been described in detail so as not to unnecessarily obscure the embodiments.

According to an embodiment as shown in FIGS. 1-9, a two-stroke engine 10 is provided in which a crank case 12 of the engine 10 does not form part of a scavenging process. In automotive usage, scavenging is the process of pushing exhausted gas-charge out of the cylinder and drawing in a fresh draught of air or fuel/air mixture for the next cycle.

As shown in FIGS. 1-9, a main piston 14 is located in a first cylinder 16 and a pumping piston 18 is located within a secondary cylinder 20 located below the first cylinder 16 and above the crank case 12. The pumping piston 18 slides along the length of the main piston 14 to seal off the first and secondary cylinders, 16 and 20, from the crank case 12. The pumping piston 18 essentially functions as a variable volume crank case, as well as a "phased" scavenging system.

Figure 2:
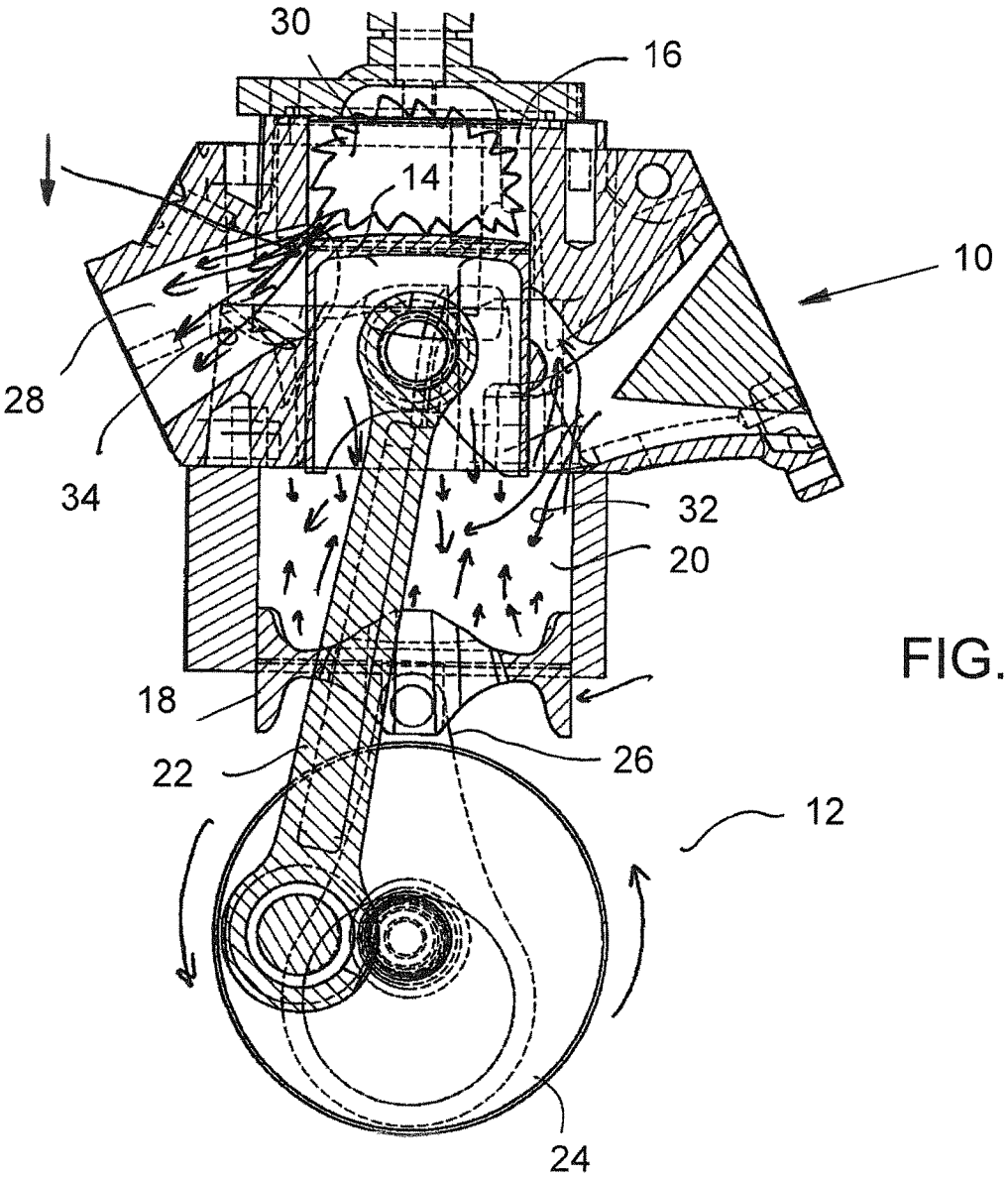
FIG. 2 is a cross-section through a cylinder of a two-stroke engine with the primary piston at 90° after top dead center (ATDC) position according to an embodiment.

For example, as best shown in FIG. 2, the drive rod 22 of the main piston 14 extends through the pumping piston 18 and is connected to the crankshaft 24 for rotation thereabout. The drive rod 26 of the pumping piston 18 is also connected to the crankshaft 24 approximately 90° ahead of the main piston 14. Thus, in FIG. 2, when the main piston 14 is at a 90° ATDC (after top dead center) position, the pumping piston 18 is at a BDC (bottom dead center) position and remains 90° ahead of the main piston 14 throughout the rotation of the crankshaft 24. The benefits of the above described arrangement are more efficient use of transfer port timing and the ability to create a positive push to the transfer flow, which make the transfer process less dependent on an expansion chamber pipe.

The engine 10 can also include a sliding gate valve (not shown) that is extendable over the exhaust port 28. The sliding gate valve may project upwardly from the pumping piston 18 as the reciprocating motion of the pumping piston is already in time with the exhaust valve. Thus, no other external valving system would be needed to position the sliding gate valve over the exhaust port 28 to close the exhaust port 28 or to remove the gate valve from the exhaust port 28 to open the exhaust port 28.

Turning to FIGS. 1-9, in FIG. 1, combustion 30 has just occurred and the main piston 14 is traveling downward powered by the combustion. In FIG. 1, the main piston 14 is at a 45° ATDC position with the pumping piston at a 135° ATDC position. Thus, the pumping piston 18 is moving in its downward stroke ingesting fresh intake charge 32.

In FIG. 2, the main piston 14 has reached about a 90° ATDC position and the exhaust port 28 has just been cracked open and the exhaust gases 34 from the combustion 30 are starting to exit through the exhaust port 28. The intake charge 32 under the primary piston 14 has stopped filling because the pumping piston 18 has reached its BDC position and will thereafter start heading upward to compress the fresh intake mixture 32.

Figure 3:
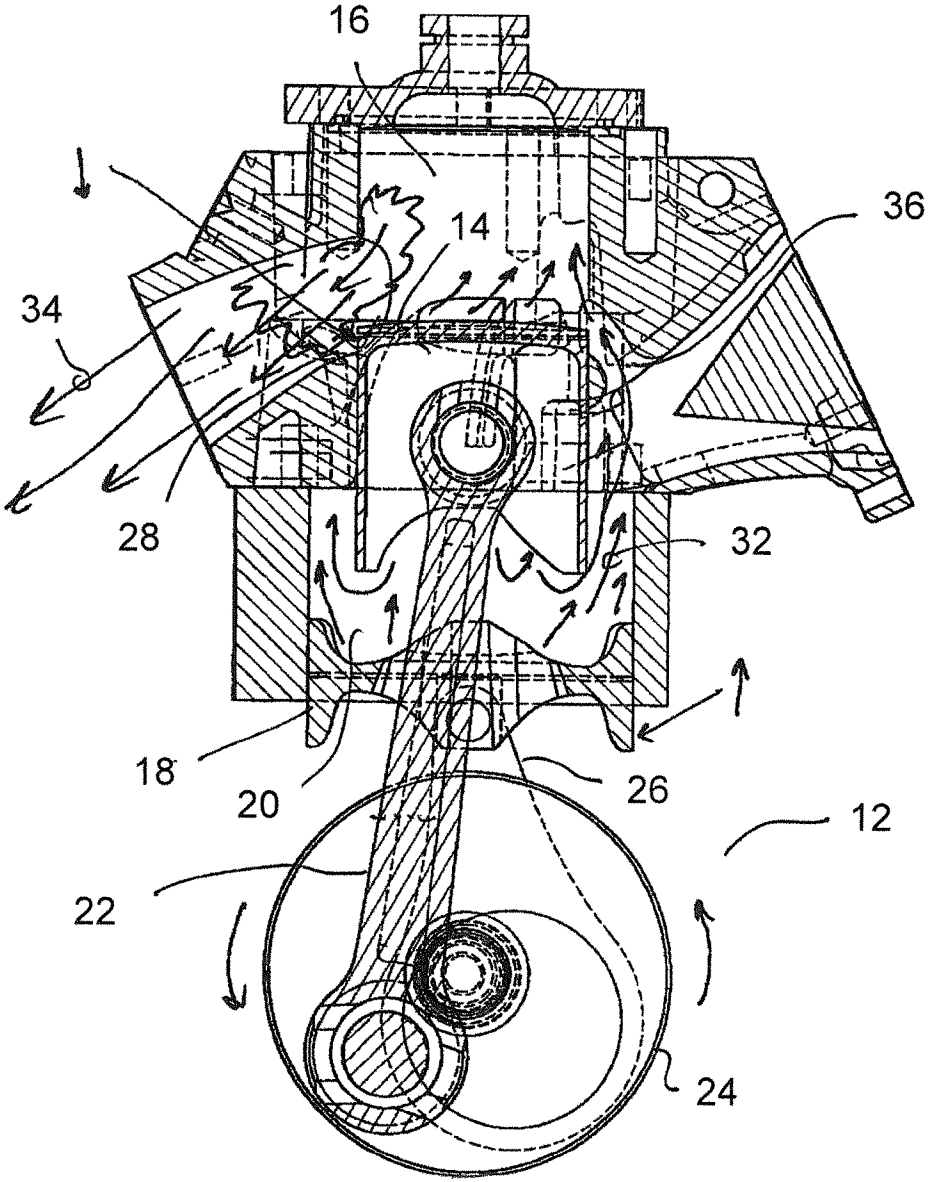
FIG. 3 is a cross-section through a cylinder of a two-stroke engine with the primary piston at 135° after top dead center (ATDC) position according to an embodiment.

In FIG. 3, the exhaust gases 34 have all but escaped the combustion chamber and the fresh intake charge mixture 32 is starting to fill the first cylinder 16 due to the position of the main piston 14 opening the transfer ports 36. The pumping piston 18 has started to move up in its stroke and is helping to push the fresh intake mixture 32 through the transfer ports 36 up into the first cylinder 16. In FIG. 3, the main piston 14 is at the 135° ATDC position.

Figure 4:
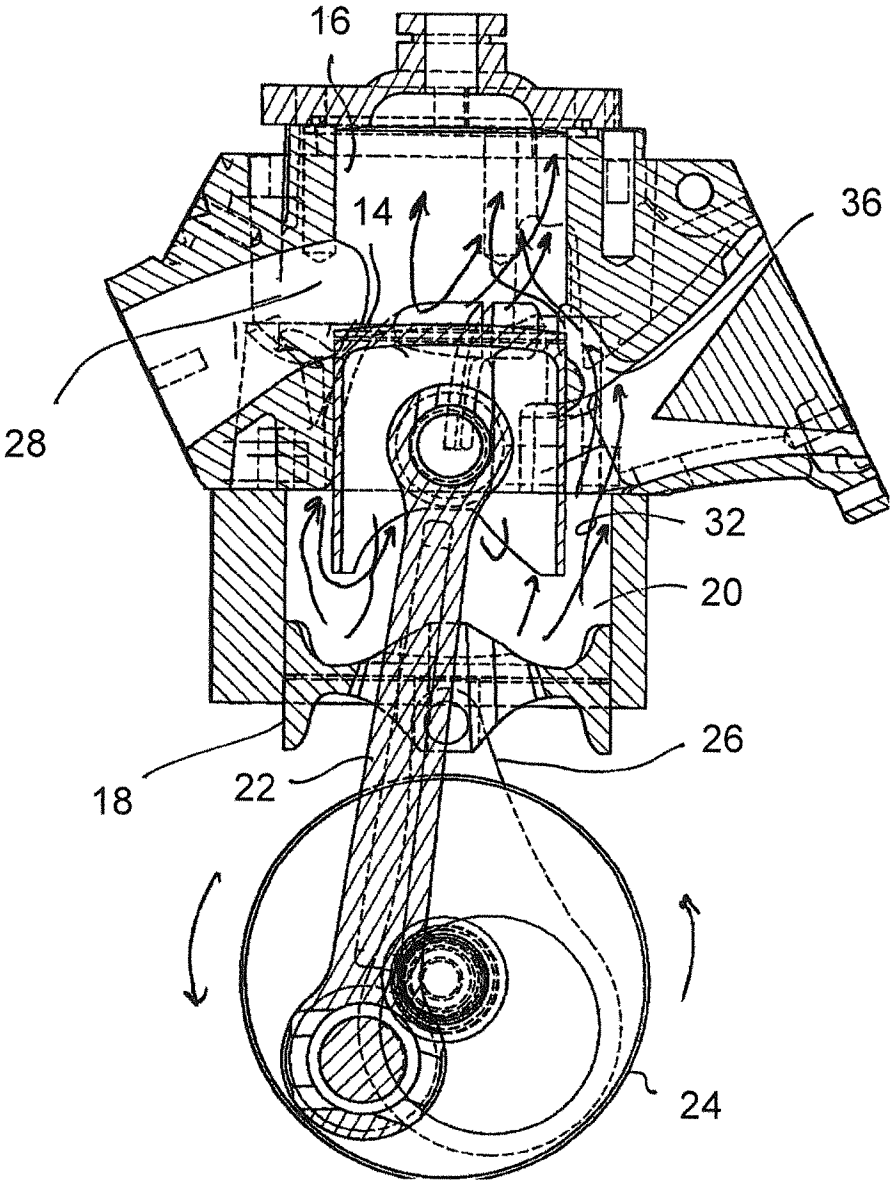
FIG. 4 is a cross-section through a cylinder of a two-stroke engine with the primary piston at 135° after top dead center (ATDC) position according to an embodiment.

In FIG. 4, the main piston 14 has almost reached the BDC position and a conventional intake transfer phase will have typically started to slow down at this point. However, this is not true in the illustrated embodiment because the pumping piston 18 is still traveling up its bore in the secondary cylinder 20 and thereby is continuing to compress and push the fresh intake charge 32 through the transfer ports 36. At this point, the sliding gate valve which may extend from the pumping piston will be in position to close the exhaust port 28.

Figure 5:
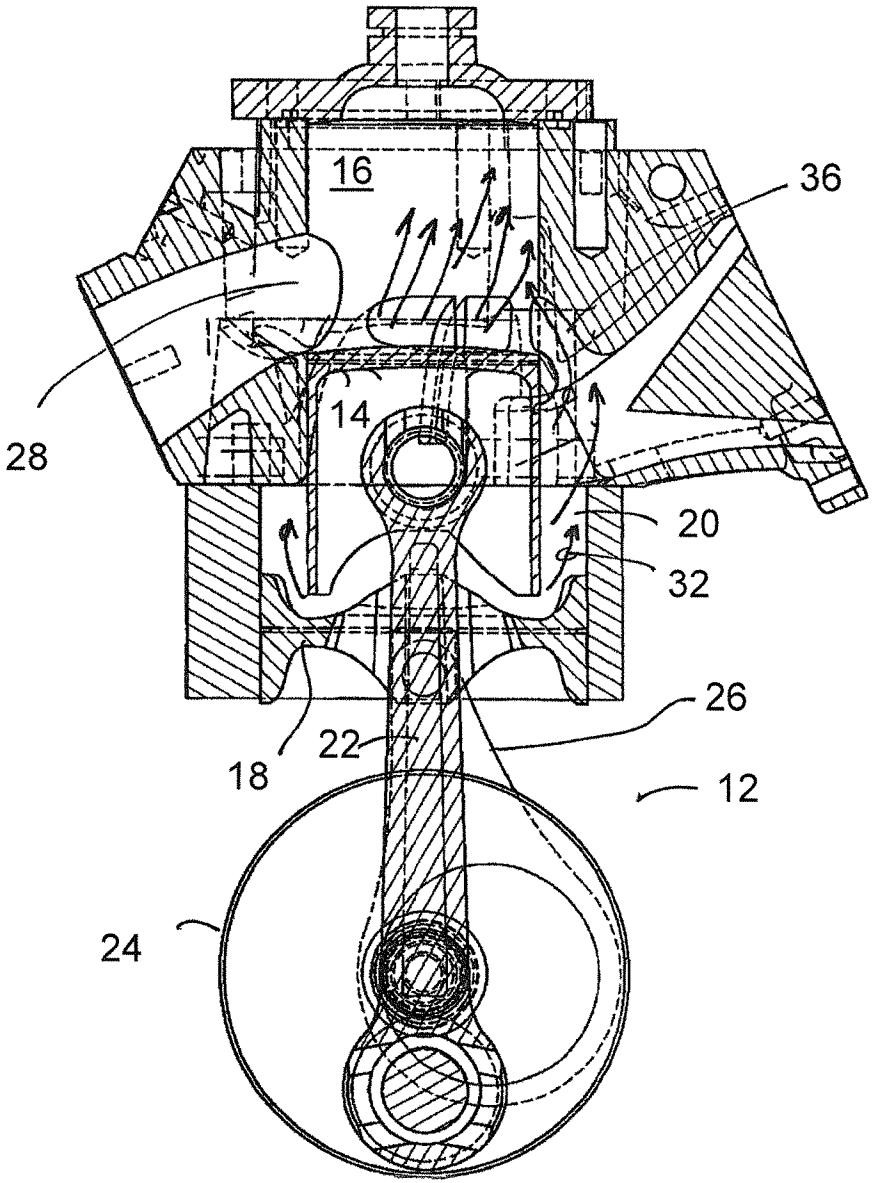
FIG. 5 is a cross-section through a cylinder of a two-stroke engine with the primary piston at bottom dead center (BDC) position according to an embodiment.

In FIG. 5, the main piston 14 is at a BDC position and the pumping piston 18 is at about a 90° BTDC (before top dead center) position with 90° of rotation remaining for further transfer pumping as described above.

Figure 6:
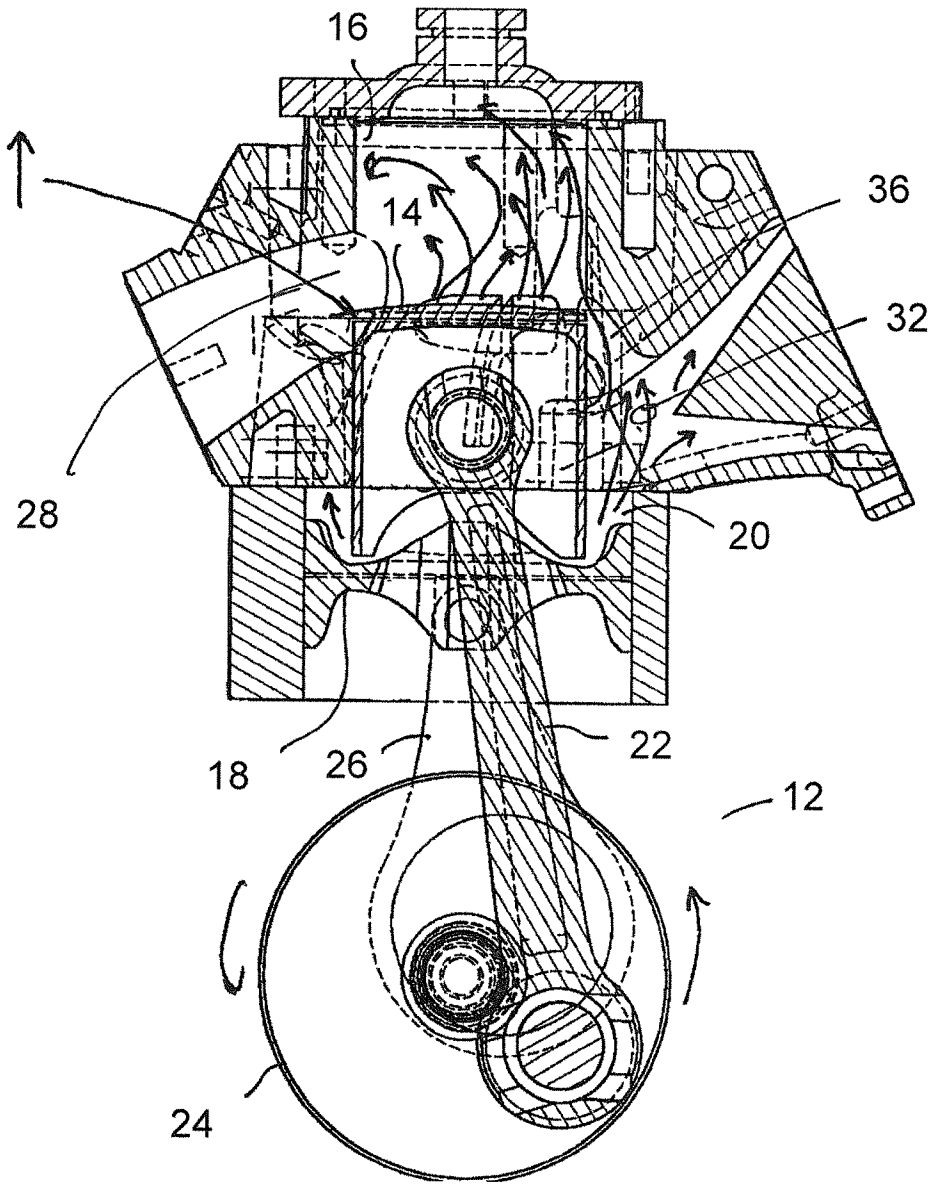
FIG. 6 is a cross-section through a cylinder of a two-stroke engine with the primary piston at 135° before top dead center (BTDC) position according to an embodiment.

In FIG. 6, the main piston 14 is at a 135° BTDC position on its way up to start compressing the fresh intake mixture 32 in the first cylinder 16. In a typical two-stroke engine, the charge might start to travel back down the transfers because of lack of positive pressure in the crank case; however, because the pumping piston 18 is there aiding in the pumping of the transfers, the transfer flow will keep on flowing out the transfer ports 36 into the first cylinder 16 helping to charge the first cylinder 16 thereby aiding in power and efficiency.

Figure 7:
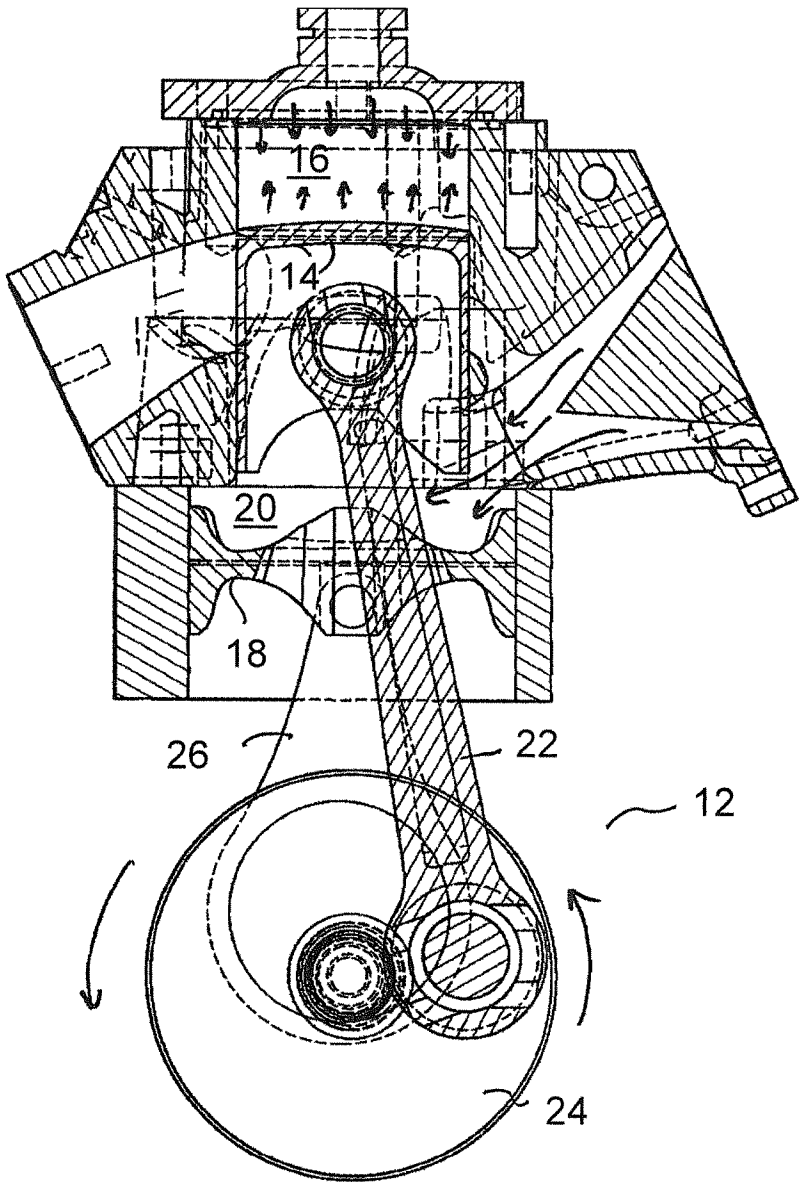
FIG. 7 is a cross-section through a cylinder of a two-stroke engine with the primary piston at 90° before top dead center (BTDC) position according to an embodiment.

In FIG. 7, the main piston 14 has closed off the transfer ports 36 and is starting to compress the mixture in the top part of the first cylinder 16. At this time, the pumping piston 18 is at its TDC (top dead center) position and is about to start moving downward to thereby start ingesting the next new intake charge.

Figure 8:
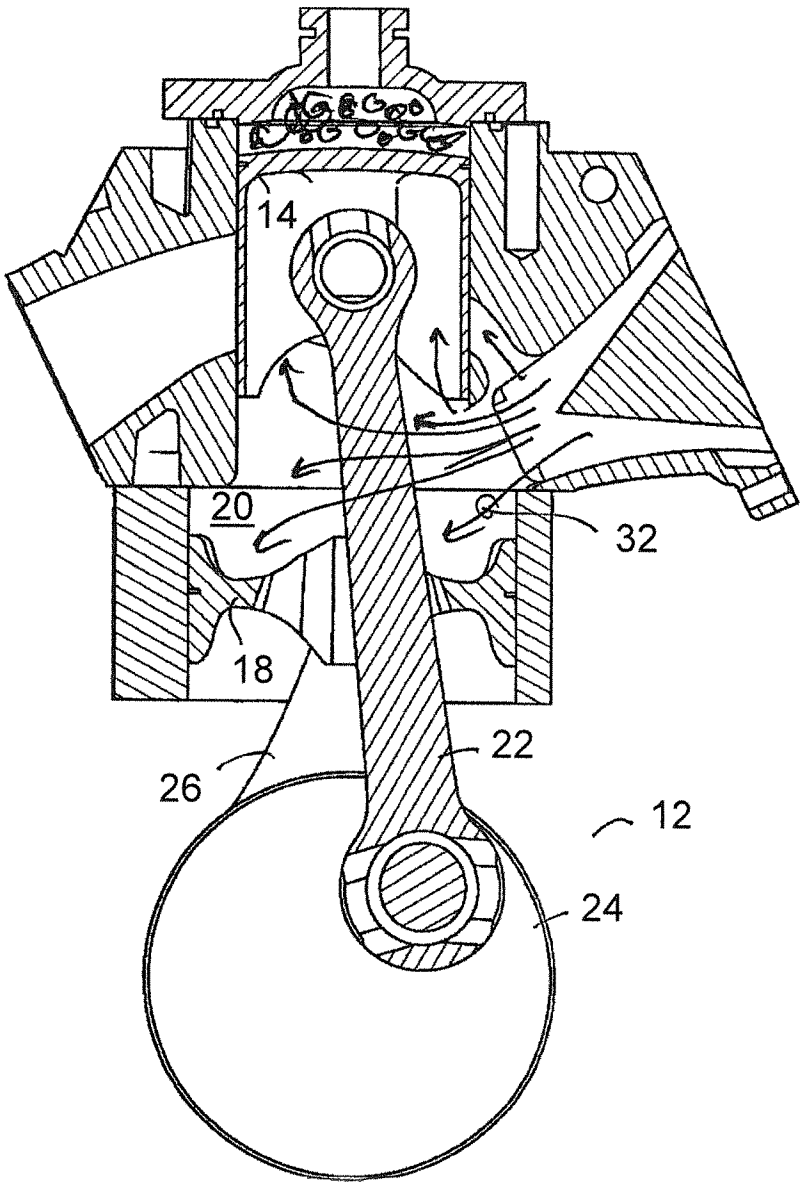
FIG. 8 is a cross-section through a cylinder of a two-stroke engine with the primary piston at 45° before top dead center (BTDC) position according to an embodiment.

In FIG. 8, the main piston 14 is at a 45° BTDC position getting ready to ignite the fuel/air mixture. The pumping piston 18 is at about a 45° ATDC and has already created a good low pressure below the main piston 14 for the next new intake charge to start filling the space under the main piston 14.

Figure 9:
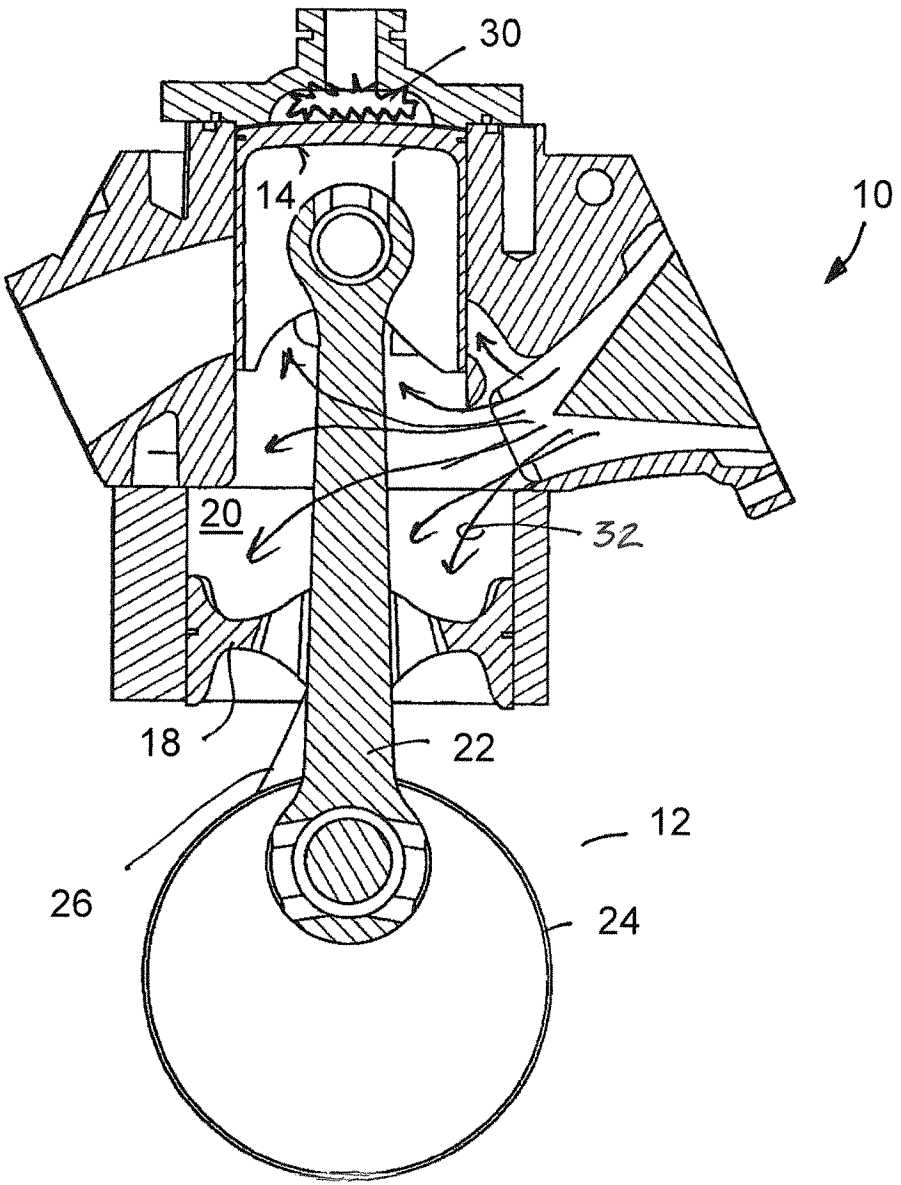
FIG. 9 is a cross-section through a cylinder of a two-stroke engine with the primary piston at top dead center (TDC) position according to an embodiment.

In FIG. 9, combustion has occurred and the main piston 14 is at a TDC position and the inlet expansion phase will be at its greatest at this crank angle. The pumping piston 18 is at a 45° ATDC traveling downward in its stroke helping to create a negative pressure ratio to aid the next new intake charge coming through the intake tract into the secondary cylinder 20. This means that the pumping piston 18 helps the engine ingest more intake charge than it would without it.

At this point, the pistons are as shown in FIG. 1 to start the phase over again.

The above description illustrates an embodiment of how aspects of the present invention may be implemented and should not be deemed to be the only embodiment. One of ordinary skill in the art will appreciate that based on the above disclosure, other arrangements, embodiments, implementations and equivalents may be employed without departing from the scope hereof.

Figure 10:
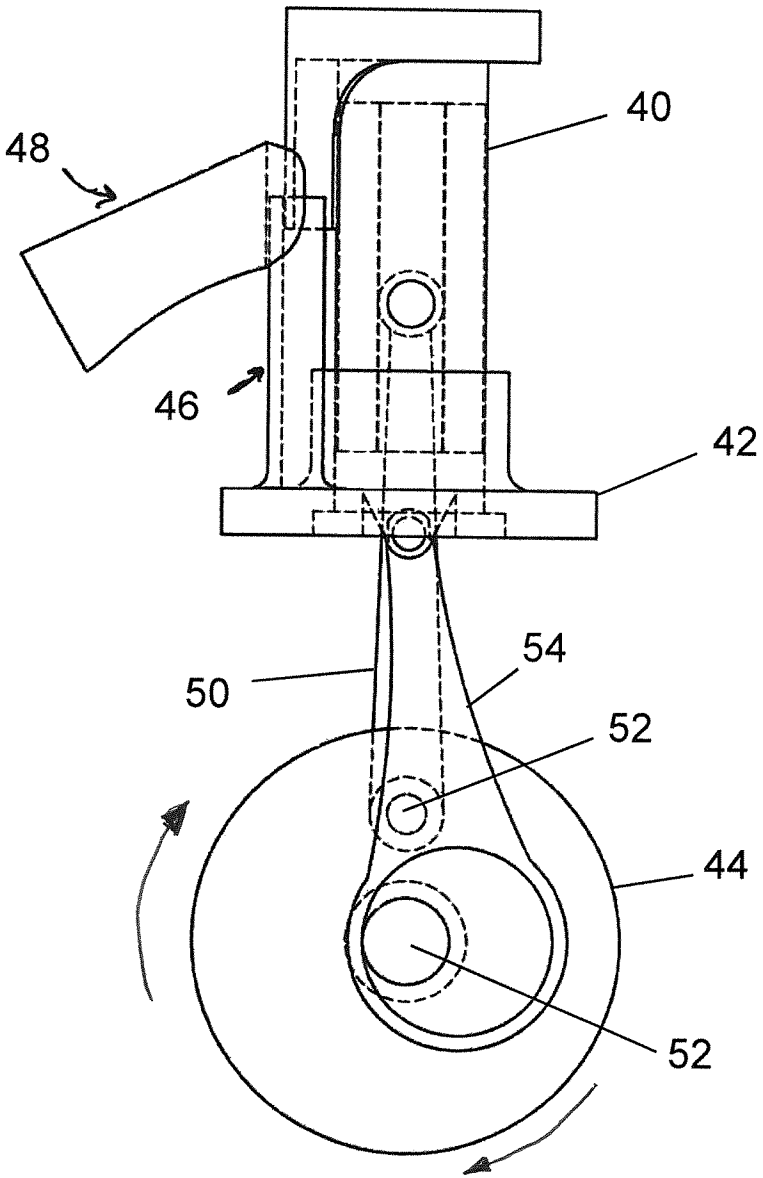
FIG. 10 is a cross-sectional view of an alternate embodiment with the stepped piston at a TDC (top dead center) position.
Figure 11:
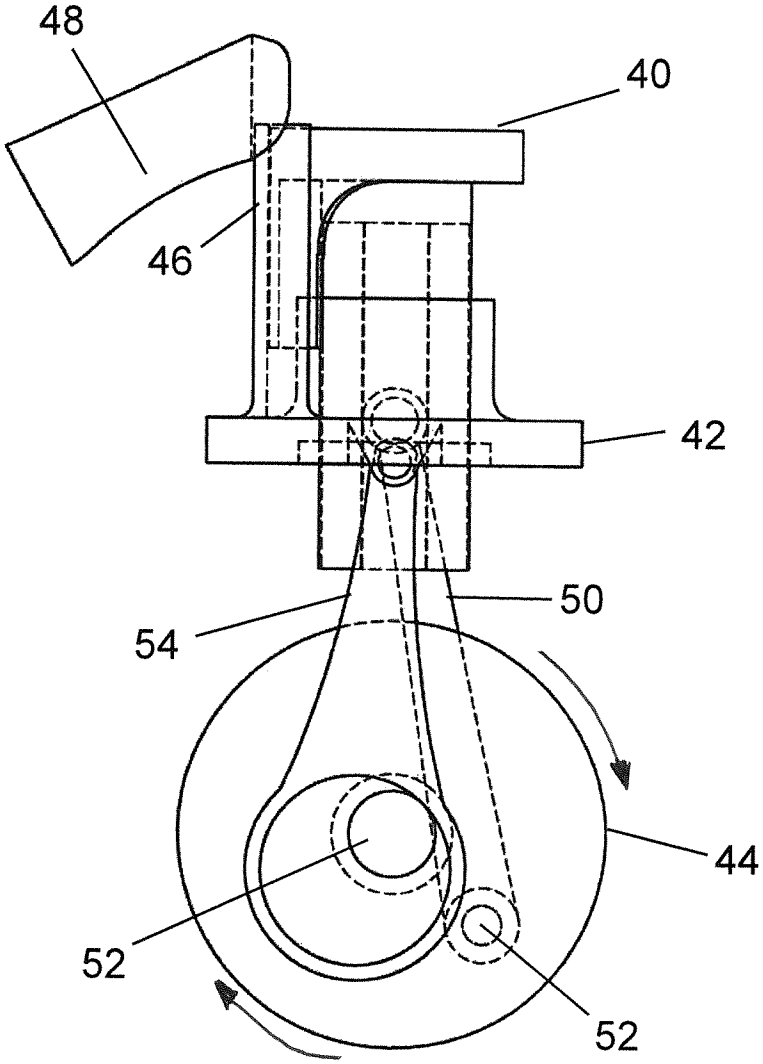
FIG. 11 is a cross-sectional view of the alternate embodiment of FIG. 10 with the stepped piston at a 135° ATDC (after top dead center) position.
Figure 12:
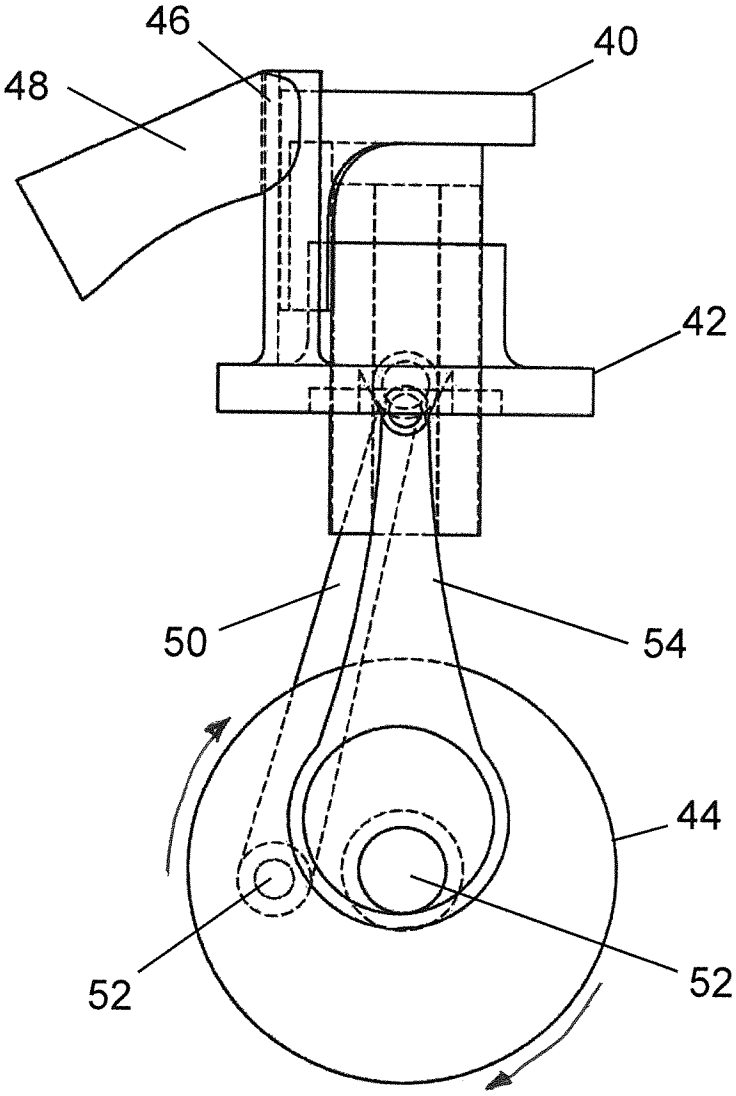
FIG. 12 is a cross-sectional view of the alternate embodiment of FIG. 10 with the stepped piston at a 90° BTDC (before top dead center) position.

By way of example, while the discussion above may be directed to a conventional non-stepped piston design, embodiments may also be utilized with stepped piston arrangements. For instance, an alternate embodiment is shown in FIGS. 10-12 having a stepped-piston 40 and a pumping piston and exhaust valve 42. This alternate embodiment is similar in most ways to the embodiment illustrated in FIGS. 1-9 discussed above. For instance, the pumping piston 42 is located below the stepped-piston 40 and above a crank case 44.

In this embodiment, the pumping piston 42 slides along a length of the stepped-piston 40 and has a sliding gate valve 46 that is extendable over an exhaust port 48. The sliding gate valve 46 projects upwardly from the pumping piston 42 and the reciprocating motion of the pumping piston 42 positions the sliding gate valve 46 over the exhaust port 48 to close the exhaust port 48 or to remove the gate valve 46 from the exhaust port 48 to open the exhaust port 48.

A drive rod 50 of the stepped piston 40 extends through the pumping piston 42 and is connected to a crankshaft 52 for rotation thereabout. For instance, FIG. 10 illustrates the TDC (top dead center) position of the stepped piston 40, FIG. 11 illustrates the 135° ATDC (after top dead center) position of the stepped piston 40, and FIG. 12 illustrates the 90° BTDC (before top dead center) position of the stepped piston 40.

A drive rod 54 of the pumping piston 42 is also connected to the crankshaft 52 approximately 90° ahead of the stepped piston 40. Thus, for instance, when the stepped piston 40 is at a 90° BTDC (below top dead center) position (see FIG. 12), the pumping piston 42 is at a TDC (top dead center) position and remains 90° ahead of the stepped piston 40 throughout the rotation of the crankshaft 24.

As the pumping piston 40 is moved from the TDC position (see FIG. 10) to the 135 ATDC position (FIG. 11), the exhaust port 48 opens and gases are permitted to flow therethrough. However, on the upstroke of the pumping piston 42, see the movement from FIGS. 11 to 12, the sliding gate valve 46 moves into a position to seal the exhaust port 48.

Accordingly, the specification and figures are to be regarded in an illustrative rather than a restrictive sense, and all such modifications are intended to be included within the scope of the present invention.

I claim:

1. A piston arrangement for an engine, comprising:

a crankshaft located within a crank case;

a primary piston located within a first cylinder and interconnected to said crankshaft by a first drive rod for converting reciprocating motion of said primary piston within said first cylinder driven by combustion occurring within said first cylinder into rotational motion of said crankshaft; and a pumping piston located within a second cylinder and interconnected to said crankshaft by a second drive rod for converting the rotational motion of said crankshaft into reciprocating motion of said pumping piston within said second cylinder;

said pumping piston being located between said primary piston and the crank case and sealing said first and second cylinders from the crankcase; and the reciprocating motion of said pumping piston within said second cylinder aids in drawing fresh air or air-and-fuel mixture into the first and second cylinders for a new cycle and aids in pushing exhausted gas-charge of a previous cycle out through an exhaust port.

2. The piston arrangement according to claim 1, wherein said first drive rod extends through the pumping piston.

3. The piston arrangement according to claim 1, wherein the reciprocating motion of the pumping piston is out of phase with the reciprocating motion of the primary piston.

4. The piston arrangement according to claim 1, wherein the second drive rod is connected to the crankshaft at a location about 90° ahead of the location where the first drive rod is connected to the crankshaft relative to a direction of the rotational motion of the crankshaft.

5. The piston arrangement according to claim 1, further comprising a sliding gate valve for the exhaust port, said sliding gate valve projecting from the pumping piston such that is extendable and retractable relative to the exhaust port via the reciprocating movement of the pumping piston.

6. The piston arrangement according to claim 1, wherein the exhaust port is located on said first cylinder.

7. The piston arrangement according to claim 1, further comprising transfer ports on said first cylinder through which the fresh air or air-fuel mixture flows from below the primary piston to above the primary piston within the first cylinder.

8. A two-stroke engine having the piston arrangement according to claim 1.

9. A stepped-piston two-stroke engine having the piston arrangement according to claim 1.

10. A piston arrangement for an engine, comprising:

a crankshaft located within a crank case;

a primary piston interconnected to said crankshaft by a first drive rod; and a pumping piston interconnected to said crankshaft by a second drive rod, said pumping piston being located between said primary piston and said crankshaft and being slidable along a length of said primary piston.

11. The piston arrangement according to claim 10, wherein the primary piston is a stepped piston.

12. The piston arrangement according to claim 10, wherein said first drive rod extends through said pumping piston.

13. The piston arrangement according to claim 10, wherein reciprocating motion of said pumping piston is out of phase with reciprocating motion of said primary piston.

14. The piston arrangement according to claim 10, wherein the second drive rod is connected to the crankshaft at a location about 90° ahead of the location where the first drive rod is connected to the crankshaft relative to a direction of the rotational motion of the crankshaft.

15. The piston arrangement according to claim 10, further comprising a sliding gate valve for opening and closing an exhaust port, said sliding gate valve projecting from the pumping piston such that is extendable and retractable relative to the exhaust port via reciprocating movement of the pumping piston.

* * * * *